US012256771B2

(12) United States Patent
Turtola

(10) Patent No.: US 12,256,771 B2
(45) Date of Patent: Mar. 25, 2025

(54) LIGHTWEIGHT SEPARATING BASE PAPER

(71) Applicant: DELFORTGROUP AG, Traun (AT)

(72) Inventor: Tuomas Turtola, Lukana (FI)

(73) Assignee: DELFORTGROUP AG, Traun (AT)

( * ) Notice: Subject to any disclaimer, the term of this patent is extended or adjusted under 35 U.S.C. 154(b) by 958 days.

(21) Appl. No.: 17/257,807

(22) PCT Filed: May 14, 2019

(86) PCT No.: PCT/EP2019/062260
§ 371 (c)(1),
(2) Date: Jan. 4, 2021

(87) PCT Pub. No.: WO2020/020503
PCT Pub. Date: Jan. 30, 2020

(65) Prior Publication Data

US 2021/0274831 A1 Sep. 9, 2021

(30) Foreign Application Priority Data

Jul. 27, 2018 (DE) ..... 10 2018 118 271.6

(51) Int. Cl.

| | |
|---|---|
| ***A24D 1/02*** | (2006.01) |
| ***A24D 1/20*** | (2020.01) |
| ***D21H 11/02*** | (2006.01) |
| ***D21H 19/12*** | (2006.01) |
| ***D21H 19/40*** | (2006.01) |
| ***D21H 19/52*** | (2006.01) |
| ***D21H 19/54*** | (2006.01) |
| ***D21H 19/60*** | (2006.01) |
| ***D21H 19/82*** | (2006.01) |
| ***D21H 27/00*** | (2006.01) |

(52) U.S. Cl.
CPC ..... *A24D 1/02* (2013.01); *A24D 1/20* (2020.01); *D21H 11/02* (2013.01); *D21H 19/12* (2013.01); *D21H 19/40* (2013.01); *D21H 19/52* (2013.01); *D21H 19/54* (2013.01); *D21H 19/60* (2013.01); *D21H 19/828* (2013.01); *D21H 27/00* (2013.01)

(58) Field of Classification Search
CPC ..... D21H 27/10; D21H 19/34; D21H 19/52; D21H 19/38; D21H 27/00; D21H 11/18; D21H 11/20; D21H 19/36; D21H 19/54; D21H 19/80; D21H 19/82; D21H 19/828; D21H 19/84; D21H 21/16; D21H 27/001; D21H 19/12; D21H 19/40; D21H 5/16; D21H 19/826; D21H 11/02; D21H 19/60; A24D 1/02; A24D 1/20; C09D 103/04
See application file for complete search history.

(56) References Cited

U.S. PATENT DOCUMENTS

| | | | | |
|---|---|---|---|---|
| 5,227,024 | A * | 7/1993 | Gomez | D21H 17/02 162/149 |
| 5,730,840 | A * | 3/1998 | Hampl, Jr. | A24D 1/02 131/365 |
| 5,807,781 | A | 9/1998 | Reinhardt et al. | |
| 9,718,980 | B2 * | 8/2017 | F. Chin | C09D 101/02 |
| 9,950,858 | B2 * | 4/2018 | Byrd, Jr. | D21H 5/16 |
| 10,231,481 | B2 * | 3/2019 | Volgger | D21H 17/67 |
| 10,405,573 | B2 * | 9/2019 | Pesendorfer | A24D 1/027 |
| 11,248,343 | B2 * | 2/2022 | Knöös | C09D 7/70 |
| 11,274,399 | B2 * | 3/2022 | Svending | D21H 19/52 |
| 11,572,659 | B2 * | 2/2023 | Phipps | D04H 3/08 |
| 11,639,579 | B2 * | 5/2023 | Parker | D21H 11/14 162/146 |
| 11,649,382 | B2 * | 5/2023 | Dufour | C09J 7/21 428/481 |
| 11,655,594 | B2 * | 5/2023 | Husband | D21H 27/10 428/323 |
| 11,976,420 | B2 * | 5/2024 | Wahlstrom | D21H 17/28 |
| 2006/0231226 | A1 | 10/2006 | Makinen | |
| 2015/0059996 | A1 | 3/2015 | Zitturi et al. | |
| 2017/0350074 | A1 * | 12/2017 | Kinast | D21H 19/46 |

(Continued)

FOREIGN PATENT DOCUMENTS

| | | | | |
|---|---|---|---|---|
| DE | 603 11 257 | T2 | 2/2008 | |
| DE | 20 2009 018 764 | U1 | 4/2013 | |
| EP | 3 059 344 | A1 | 8/2016 | |
| EP | 2 861 800 | B1 | 2/2017 | |
| EP | 2770857 | B1 * | 8/2018 | A24D 1/02 |
| EP | 3974580 | A1 * | 3/2022 | B65D 65/42 |
| EP | 3870755 | B1 * | 4/2024 | D21C 5/02 |
| JP | 2021531033 | A * | 11/2021 | A24D 1/02 |
| JP | 7291776 | B2 * | 6/2023 | A24D 1/02 |
| WO | 03/100167 | A1 | 12/2003 | |
| WO | WO-2013164646 | A1 * | 11/2013 | D21H 19/10 |
| WO | WO-2020041272 | A1 * | 2/2020 | D21H 11/14 |
| WO | WO-2021037659 | A1 * | 3/2021 | A24C 5/005 |

OTHER PUBLICATIONS

International Searching Authority/European Patent Office, International Search Report and the Written Opinion of the International Searching Authority, Application No. PCT/EP2019/062260, mailed Jul. 16, 2019, *with English translation of the International Search Report*, 19 pages.

(Continued)

*Primary Examiner* — Jose A Fortuna
(74) *Attorney, Agent, or Firm* — Barclay Damon LLP

(57) ABSTRACT

The invention relates to a separating base paper, having a mass per unit area of at least 25 g/m$^2$ and at most 40 g/m$^2$ and a density of at least 0.90 g/cm$^3$ and at most 1.15 g/cm$^3$. The separating base paper comprises at least 50 wt % of long-fiber pulp and is coated on at least one side with at least two coatings. The first coating is located between a paper surface and the second coating. The second coating is a topmost coating and comprises a water-soluble film-forming polymer, nanofibrillated cellulose, microfibrillated cellulose or nanocrystalline cellulose. The Cobb-Unger (120 s) value of the surface having said first and second coatings is at least 0.01 g/m$^2$ and at most 0.90 g/m$^2$.

30 Claims, No Drawings

(56) References Cited

U.S. PATENT DOCUMENTS

| | | | | |
|---|---|---|---|---|
| 2020/0063361 | A1* | 2/2020 | Everett | D21H 15/10 |
| 2021/0274831 | A1* | 9/2021 | Turtola | D21H 19/34 |
| 2022/0316140 | A1* | 10/2022 | Svending | D21H 11/18 |
| 2024/0034038 | A1* | 2/2024 | Milliery | C09D 101/02 |
| 2024/0167225 | A1* | 5/2024 | Reeve-Larson | D21H 19/824 |
| 2024/0167227 | A1* | 5/2024 | Reeve-Larson | D21H 11/04 |

OTHER PUBLICATIONS

Frank-PTI GmbH, Cobb-Unger Oil & Water Absorption Tester, www.frank-pti.com; Article No. S95333, Mar. 2017, (*with English translation*), 2 pages.

* cited by examiner

LIGHTWEIGHT SEPARATING BASE PAPER

CROSS-REFERENCE TO RELATED APPLICATIONS

This application is the national phase entry of International Patent Application No. PCT/EP2019/062260 filed on May 14, 2019, and claims the benefit of German Patent Application No. 10 2018 118 271.6 filed Jul. 27, 2018, the disclosures of which are incorporated herein by reference in their entirety.

FIELD OF INVENTION

The invention relates to a release base paper with a low basis weight but otherwise equal or better technical properties compared with a conventional release base paper, in particular with regards to the resistance against the absorption of silicone. In particular, the invention relates to a release base paper with a low basis weight and a special two-layered coating and the use of the release base paper for siliconizing.

BACKGROUND AND PRIOR ART

A release base paper is a paper that is intended to be coated with silicone. Once it is coated with silicone, it can be used as a carrier paper for self-adhesive labels, as baking paper or in other applications that require release properties, which can be achieved by siliconization.

For release base paper, certain technical requirements are of importance. The silicone, which is applied later on, is usually applied in amounts of only 1 g/m$^2$ to 2 g/m$^2$ on the full surface of the release base paper. Although this amount is very low, the silicone has to cover 100% of the surface of the release base paper, otherwise, for example, labels cannot be released completely from the siliconized release base paper. Therefore, the penetration of the silicone into the release base paper plays an important role and it should be as low as possible. The ability of a release base paper to allow only a little penetration of the silicone, but at the same time to produce a closed coating, is called silicone holdout.

The release base paper should have a high transparency. In many applications, the self-adhesive labels are removed from the siliconized release base paper by machines which detect the presence of a label through the release base paper by means of optical sensors. This detection can only work reliably if the release base paper is sufficiently transparent.

Finally, the self-adhesive label material is firstly applied to the entire surface of the siliconized release base paper and then the self-adhesive label material is typically cut into individual labels of the desired shape and size by die-cutting. Clearly, during die-cutting, only the self-adhesive label material should be cut, but not the release base paper. This requires a certain density and compressibility of the release base paper.

Furthermore, there are additional technical requirements such as a good tensile strength, a good tearing strength, a suitable tensile energy absorption and thickness, which all influence the productivity of a machine for processing such release base papers.

Conventional release base papers have a basis weight of about 50 g/m$^2$ to about 60 g/m$^2$ in order to fulfill all technical requirements. However, the siliconized release base paper has to be disposed of after use, for example, after the self-adhesive labels have been removed. Siliconized release base papers are difficult to recycle because of the silicone coating; thus, there is an interest in reducing the amount of waste that is generated by such siliconized release base papers. It has proven difficult to reduce the basis weight of release base papers and thus the amount of waste that is generated, because the aforementioned technical requirements cannot be complied with sufficiently. Therefore, lightweight release base papers have so far not gained commercial relevance.

There is thus an interest in having a lightweight release base paper available, which is at least equivalent in its technical performance in comparison with heavier conventional release base papers from the prior art.

SUMMARY OF THE INVENTION

It is the object of the invention to provide a release base paper that has a low basis weight but in spite of this still fulfills the technical requirements that are expected of a release base paper, such as good silicone holdout and trouble-free processability. This object can be achieved by a release base paper according to claim 1 and a process for manufacturing it according to claim 25. Advantageous embodiments are provided in the dependent claims. Further aspects of the invention relate to a self-adhesive label that uses the release base paper according to the invention, a baking paper that is based on the release base paper of the present invention, the use of the release base paper according to the invention for wrapping a smokable material, a smoking article obtained thereby, as well as the use of the release base paper according to the invention as a packaging paper.

The inventor has found that this object can be achieved by a release base paper that has a basis weight of at least 25 g/m$^2$ and at most 40 g/m$^2$ and a density of at least 0.90 g/cm$^3$ and at most 1.15 g/cm$^3$, wherein the release base paper comprises at least 50% by weight of softwood pulp and is coated on at least one side with at least two coatings, wherein the first coating is located between the paper surface and the second coating and wherein the second coating is the topmost coating and comprises a water-soluble, film-forming polymer, nano-fibrillated cellulose, micro-fibrillated cellulose or nano-crystalline cellulose, and wherein the Cobb Unger (120 s) value of the coated surface is at least 0.01 g/m$^2$ and at most 0.90 g/m$^2$.

The release base paper according to the invention has a basis weight of at least 25 g/m$^2$, preferably at least 30 g/m$^2$ and at most 40 g/m$^2$, preferably at most 38 g/m$^2$. The basis weight can be determined in accordance with ISO 536:2012 and describes the basis weight of the finished release base paper, including the at least two coatings, but without the silicone coating. The reduction in basis weight achieves a substantial reduction in waste material of about 50%, but without further measures, a simple reduction in basis weight does not lead to a release base paper with satisfactory technical properties.

Thus, the inventor has found that the release base paper according to the invention must have a density of at least 0.90 g/cm$^3$, preferably at least 0.95 g/cm$^3$, particularly preferably at least 0.99 g/cm$^3$ and at most 1.15 g/cm$^3$, preferably at most 1.10 g/cm$^3$, particularly preferably at most 1.07 g/cm$^3$ and most preferably at most 1.05 g/cm$^3$. The density of the release base paper is related to its compressibility. After the release base paper is coated with silicone and after the label material has been applied, the label material is cut, typically by die-cutting. It is important, particularly in die-cutting, that only the label material but not the siliconized release base paper is cut, and therefore the release base paper must yield to the pressure of the die by a defined distance. Generally, density and compressibility are closely related, so that conventional release base papers require a density of at least 1.17 g/cm$^3$ in order to achieve the desired compressibility. However, the release base paper according to the invention has a low basis weight and thus a low thickness, and thus it already yields less to the pressure of the die than conventional release base papers. Therefore, for the release base paper according to the invention, the density can be lower than for conventional release base papers.

The density of the release base paper is generally achieved in a calendering process, wherein the paper is compressed between several pairs of rolls, each pair of rolls forming a nip. As the release base paper according to the invention does not need such a high density, fewer nips are required compared with conventional release base papers, which means a saving in energy and production effort.

However, a lower density leads to a more porous paper structure and may worsen silicone holdout. The inventor has found that this disadvantage can be overcome by the said coatings, which will be described further below by way of exemplary embodiments.

The reduction in basis weight can lead to a reduction in tensile strength, so that the release base paper breaks more frequently during processing. The inventor has found that a particularly good tensile strength can be achieved if the release base paper comprises at least 50% by weight of softwood pulp, preferably at least 60% by weight and particularly preferably at least 70% by weight.

The air permeance of the release base paper is related to the porosity of the release base paper and thus influences the absorption of silicone. Generally, a higher porosity and a higher air permeance lead to the absorption of more silicone. Consequently, the air permeance should be as low as possible. The air permeance can be measured according to the Gurley method as defined in ISO 5636-5:2013. Here, the time for a certain volume of air to pass through a defined area of the paper under defined pressure conditions is measured. For papers with very low air permeance, that is very high Gurley values, the measurement time can be very long. In this case, it is common to stop the measurement after some time and then to determine by extrapolation the time that would have been needed for the defined air volume to pass through the paper.

The air permeance according to the Gurley method of the release base paper according to the invention is preferably at least 40000 s, particularly preferably at least 60000 s and most preferably at least 70000 s. This is substantially higher than the air permeance according to the Gurley method of conventional release base papers, which frequently have an air permeance according to the Gurley method of less than 30000 s. Thus, the release base paper according to the invention provides the additional advantage that less silicone needs to be used for a full-surface coating.

The release base paper according to the invention comprises softwood pulp. Softwood pulp is preferably sourced from coniferous trees such as spruce, pine or fir. In preferred embodiments, at least 70% by weight, preferably at least 85% by weight of said softwood pulp is sourced from coniferous trees. Other preferred sources of softwood pulp can be plants like flax, hemp, sisal, jute or *abaci*. Mixtures of softwood pulps of different origins can also be used. The softwood pulp provides the release base paper with a particularly good tensile strength.

For the manufacture of the release base paper according to the invention, the softwood pulp is refined. Refining is an energy-intensive mechanical treatment, with the aim of exposing the fibrils of pulp fibers, but which also shortens the pulp fibers to a certain extent. Intensive refining increases the tensile strength of the paper and reduces the porosity. The effect of refining on the pulp can be measured in accordance with ISO 5267-1:1999 and is provided as degree of refining according to Schopper-Riegler (° SR). Conventional release base papers need rather intense refining in order to achieve a high density, which requires a large amount of energy. The release base paper according to the invention, however, requires a substantially lower intensity of refining, so that the refined softwood pulp preferably has a degree of refining of at least 50° SR, particularly preferably at least 60° SR and preferably at most 80° SR, particularly preferably at most 70° SR. Less intense refining additionally has positive effects on the tear strength of the release base paper. The inventor has found that the special coating of the release base paper according to the invention contributes to overcoming the disadvantages of lower tensile strength and a higher paper porosity associated with less intensive refining. Thus, the manufacture of the release base paper according to the invention requires less energy, because on the one hand, due to the low basis weight, less softwood pulp needs to refined per unit paper area, and on the other hand, the intensity of the refining can be reduced due to the special coating.

The release base paper can contain hardwood pulp, which is pulp preferably sourced from deciduous trees such as beech, birch or *eucalyptus*. A further preferred source of hardwood pulp can be grasses such as esparto grass. Mixtures of hardwood pulps of different origin can also be used. Hardwood pulp provides higher volume to the release base paper and may reduce the tensile strength, which are both not desired for the intended application. However, hardwood pulp is generally less expensive than softwood pulp and thus the release base paper may contain a proportion of hardwood pulp.

Preferably, the release base paper according to the invention comprises at most 40% by weight of hardwood pulp and particularly preferably at most 30% by weight hardwood pulp.

The release base paper can contain filler materials such as, for example, calcium carbonate, titanium dioxide, kaolin, aluminum hydroxide, magnesium silicates, aluminum silicates, talcum or mixtures thereof. Filler materials, however, have certain disadvantages as they can increase the porosity and air permeance of the release base paper and reduce the tensile strength and transparency. Preferably, the release base paper according to the invention comprises at most 15% by weight filler materials, particularly preferably at most 10% by weight and most particularly preferably less than 2% by weight filler materials. In this respect, filler materials should be distinguished from pigments that could be contained in coatings for the release base paper according to the invention. Filler materials in this respect refer only to materials that are added to the paper mass during paper production and not to materials that are applied to the surface of the paper in form of a coating.

The release base paper can furthermore contain sizing agents or other additives and processing aids, which the skilled person is able to select from experience.

The release base paper according to the invention is coated and comprises at least two coatings. These coatings substantially improve silicone holdout and, in combination with the low basis weight and the low density, ensure that the beneficial effects of the invention can be achieved.

In this regard, the object of the first coating is to seal the surface of the release base paper and prepare it for the application of the second coating. The second coating then generates a smooth, chemically homogeneous surface, which is particularly well suited to coating with silicone. Through this double coating, a lower air permeance and a higher smoothness can be achieved with less coating material than could be achieved with a single coating. Thereby, a saving in coating material is achieved, which is an advantage of the invention. This positive effect can also be achieved and detected on the release base paper if the coating materials of the first and the second coating are identical.

The first coating comprises a coating material selected from the group consisting of water-soluble film-forming polymers such as starch, starch derivatives, cellulose derivatives or latex; nano-fibrillated cellulose; nano-crystalline cellulose; micro-fibrillated cellulose and mixtures thereof, and the second coating comprises a water-soluble, film-forming polymer, nano-fibrillated cellulose, micro-fibrillated cellulose or nano-crystalline cellulose.

The release base paper according to the invention may comprise more than two coatings, as long as said first coating is located between the paper surface and said second coating, and said second coating forms the topmost coating of the release base paper. Thus, additional coatings can be located between the paper surface and said first coating or between said first coating and said second coating. Additional coatings can be used to achieve further special effects, but preferably, the release base paper according to the invention comprises precisely two coatings.

The first coating is preferably applied by means of a first coating composition comprising water and said coating material. After application of the first coating composition to the paper, the paper is dried and the amount of the dried first coating composition remaining on the release base paper according to the invention, that is, the amount of the first coating, is preferably at least 0.1 g/m$^2$, particularly preferably at least 0.4 g/m$^2$ and preferably at most 4.0 g/m$^2$ and particularly preferably at most 2.5 g/m$^2$.

The first coating composition comprises water and said coating material. The coating material makes up preferably at least 5.0% by weight, particularly preferably at least 10.0% by weight and preferably at most 25.0% by weight, particularly preferably at most 20.0% by weight, wherein each percentage refers to the weight of the first coating composition.

Preferably, the coating material in the first coating and in the first coating composition is a starch or a starch derivative and is particularly preferably selected from the group consisting of potato starch, corn starch, tapioca starch, wheat starch, derivatives of these starches, or mixtures thereof.

The first coating composition may further comprise additives, viscosity modifiers or other components that the skilled person may select in type and amount from experience in order to obtain a first coating composition which is suitable for use in the application device.

The second coating comprises a water-soluble, film-forming polymer, nano-fibrillated cellulose, micro-fibrillated cellulose or nano-crystalline cellulose and is applied in the form of a second coating composition comprising water and said water-soluble, film-forming polymer, nano-fibrillated cellulose, micro-fibrillated cellulose or nano-crystalline cellulose.

After application of the second coating composition, the paper is dried and the amount of the dried second coating composition remaining on the release base paper according to the invention, that is, the amount of the second coating, is preferably at least 0.5 g/m$^2$, particularly preferably at least 1.5 g/m$^2$ and preferably at most 5.0 g/m$^2$ and particularly preferably at most 3.0 g/m$^2$.

The second coating composition comprises water and a water-soluble film-forming polymer, nano-fibrillated cellulose, micro-fibrillated cellulose or nano-crystalline cellulose. The water-soluble film-forming polymer, the nano-fibrillated cellulose, the micro-fibrillated cellulose or the nano-crystalline cellulose preferably makes up at least 5% by weight, particularly preferably at least 8% by weight and preferably at most 25% by weight and particularly preferably at most 15% by weight, wherein each percentage refers to the weight of the second coating composition.

The second coating or the second coating composition preferably comprises pigment particles, and particularly preferably the pigment particles have a flaky shape.

The pigment particles are preferably selected from the group consisting of kaolin, talcum, magnesium silicates, aluminum silicates, calcium carbonate and mixtures thereof. Pigment particles with a flaky shape, in particular flaky calcium carbonate, kaolin or talcum, are particularly preferred.

The pigment particles, independently of whether they have a flaky shape, preferably make up at least 1% by weight, particularly preferably at least 10% by weight and preferably at most 30% by weight and particularly preferably at most 20% by weight, wherein each percentage refers to the weight of the second coating composition.

The second coating composition may further comprise viscosity modifiers, cross-linkers or other components that the skilled person may select in type and amount from experience in order to obtain a coating composition which is suitable for its use in the application device.

The water-soluble, film-forming polymer of the second coating or coating composition is preferably selected from the group consisting of polyvinyl alcohol, carboxy methyl cellulose, hydroxyl methyl cellulose, starch, starch derivatives, latex and mixtures thereof. In a particularly preferred embodiment, the second coating or coating composition comprises modified nano-fibrillated cellulose, modified micro-crystalline cellulose, modified nano-crystalline cellulose, modified polyvinyl alcohol or modified carboxy methyl cellulose, wherein these coating materials have been modified such that they contain vinyl groups that can react with silicone and thereby enhance or improve the adhesion of the silicone to the release base paper. Such modified polyvinyl alcohol, modified carboxy methyl cellulose, modified nano-fibrillated cellulose, modified micro-fibrillated cellulose or modified nano-crystalline cellulose can, for example, be obtained by processes in which some of the hydroxyl groups of the coating materials react with organic molecules that have a vinyl group so that after the reaction, the vinyl group is available for a further reaction with the silicone and the adhesion of the silicone on the surface of the release base paper is improved. The reaction with the organic molecule can occur before or after the application of the second coating composition in this regard. Such coating materials and processes for their manufacture are described, for example, in the European patents EP 2300544 or EP 2539505.

In a particularly preferred embodiment, the coating materials of the first and second coatings are different, wherein the coating material of the first coating is selected from the group consisting of starch, starch derivatives and cellulose derivatives and the coating material of the second coating is selected from the group consisting of latex, polyvinyl alcohol, nano-fibrillated cellulose, micro-fibrillated cellulose, nano-crystalline cellulose, polyvinyl alcohol modified with vinyl groups, carboxy methyl cellulose modified with vinyl groups, nano-fibrillated cellulose modified with vinyl groups, micro-fibrillated cellulose modified with vinyl groups and nano-crystalline cellulose modified with vinyl groups. Here, "modified with vinyl groups" means that some hydroxyl groups of the aforementioned coating materials have been reacted with an organic molecule which contains a vinyl group. In this regard, the reaction with the organic molecule may be carried out before or after application of the second coating composition. This vinyl group is then available for a reaction with the silicone and improves the adhesion of the silicone to the surface of the release base paper. Processes for the manufacture of modified coating materials of this type are described, for example, in EP 2300544 or EP 2539505.

The inventor has found that the two coatings aid in sealing the paper structure and creating a smooth, chemically uniform surface, which is particularly suitable for being coated with silicone. In particular, the inventor has found that in combination with a low basis weight and a low density, the coatings improve the silicone holdout so that the lightweight release base paper is suitable for a wide variety of applications. The silicone holdout, that is the ability of the paper to prevent the silicone from penetrating into the paper structure and to provide a uniform silicone coating, can be judged by measuring the Cobb Unger (120 s) value in accordance with the test described in TAPPI T462 cm-16. In this test, a defined area of the release base paper is exposed to a defined amount of an oil, typically castor oil, for a certain time, typically 120 s, and after removal of the oil, the gain in weight of the paper per unit area is determined and given as the Cobb Unger (120 s) value of the side of the paper that was exposed to the oil. The inventor has found that a low Cobb Unger (120 s) value is associated with a good silicone holdout.

Consequently, the Cobb Unger (120 s) value for the coated side of the release base paper according to the invention is at least 0.01 $g/m^2$, preferably at least 0.10 $g/m^2$, particularly preferably at least 0.15 $g/m^2$ and at most 0.90 $g/m^2$, preferably at most 0.70 $g/m^2$, particularly preferably at most 0.60 $g/m^2$ and most preferably at most 0.50 $g/m^2$. The coated side of the release base paper according to the invention is the side intended to be coated with silicone, that is, the side to which the first and the second coating composition have been applied. This value is superior than that of conventional release base papers of much higher basis weight, which typically achieve a Cobb Unger (120 s) value on the coated side of about 1.0 $g/m^2$. The Cobb Unger (120 s) value can be adjusted by selecting appropriate coating materials for the first and second coating and by the amount of the first and second coating composition that is applied to the release base paper. Generally, a higher amount will lead to a lower Cobb Unger (120 s) value.

The transparency of the release base paper is also important. The transparency can be measured in accordance with DIN 53147:1993-01 and is indicated as a percentage from 0% to 100%, wherein 0% means fully opaque and 100% means fully transparent. A high transparency is useful, as the presence of a label is often detected by means of optical sensors through the release base paper. If the transparency is too low, this detection process is unreliable or cannot be carried out at common production speeds. In general, a transparency of at least 45% is sufficient and most conventional re-lease base papers will achieve a transparency of about 50%. The release base paper according to the invention, however, achieves a substantially higher transparency of preferably at least 55%, particularly preferably of at least 60% and preferably at most 80%, particularly preferably at most 75%.

This high transparency can be achieved by the low basis weight, the absence of filler materials and by appropriate treatment of the release base paper such as calendering and coating. A high transparency makes it possible to use less expensive and less powerful optical sensors for the detection of labels or to increase the production speed, which is an additional advantage of the release base paper according to the invention.

The release base paper according to the invention can be produced by processes that are known in the prior art wherein a conventional paper machine, particularly a Fourdrinier paper machine, calendering and coating equipment are used. Preferably, the calendering equipment is integrated into the paper machine, so that the calendering can be carried out during paper production. The first and second coating composition can be applied by conventional application methods such as, for example, in a size press, in a film press, by blade coating or by a curtain coating process.

The release base paper according to the invention can be used for siliconization and then as carrier material for self-adhesive labels or as baking paper.

The inventor has also found further surprising uses for the release base paper according to the invention.

The release base paper according to the invention can be used on smoking articles. Smoking articles comprise a smokable material that is capable of generating an aerosol upon combustion, as in conventional cigarettes, or just upon heating, such as in so-called heated tobacco products or heat-not-burn products. The smokable material here is typically formed into a cylindrical rod and wrapped with a wrapping material, for example, a cigarette paper. Depending on the climatic conditions during storage or during use of the smoking article, certain substances such as oils, humectants or water can migrate from the smokable material into the wrapping material. These substances then create undesirable stains on the wrapping material. This is particularly true for smoking articles which just heat the smokable material and do not burn it, because in these smoking articles, the smokable material typically contains a comparatively high amount of humectants such as glycerol or propylene glycol. The inventor has found that the use of the release base paper according to the invention as wrapping material for smoking articles can substantially reduce the number and area of stains that are formed during storage and use.

Thus, the release base paper according to the invention can be used to wrap the smokable material of a smoking article, preferably the smokable material of a smoking article, which heats but does not burn the smokable material.

The invention thus further comprises a smoking article comprising a smokable material wrapped with the release base paper, wherein preferably, the smoking article is a smoking article that heats but does not burn the smokable material.

The inventor has found a further surprising use, also in the field of packaging papers. Due to the smoothness and the transparency of the release base paper according to the invention, it is particularly suitable for wrapping articles such as, for example, shirts, shoes or handbags. Here, the release base paper according to the invention wraps and protects the article, which is then additionally packed in an over-packaging, typically from cardboard. The transparency thereby allows the article to be seen better through the release base paper according to the invention and it is hence particularly well suited for luxury articles. The smoothness of the release base paper according to the invention allows the packaging process to be automated better than is the case with conventional papers from the prior art.

The invention therefore comprises the use of the release base paper according to the invention as a packaging paper.

DESCRIPTION OF THE PREFERRED EMBODIMENT

A release base paper according to the invention was produced from a mixture of 80% by weight softwood pulp from spruce and pine and 20% by weight hardwood pulp from birch.

The softwood pulp was refined to a degree of refining of 67° SR, measured in accordance with ISO 5267-1:1999. No filler materials were used.

The release base paper web was formed on a conventional Fourdrinier paper machine from a water-based suspension containing the mixture of refined softwood pulp and hardwood pulp and calendered in the paper machine using a calender integrated into the paper machine.

The release base paper web was then coated on the full surface with a first coating composition containing water and 15% by weight starch with respect to the weight of the first coating composition, and then dried to obtain the first coating. This step was carried out in a film press.

The entire surface of the release base paper was then coated with a second coating composition, which was applied to the first coating, consisting of 8% by weight polyvinyl alcohol, 15% by weight kaolin particles, a small amount of cross-linker and water, wherein the percentages refer to the weight of the coating composition. The second coating composition was applied in a blade coater and dried to obtain the second coating and therefore also the finished release base paper according to the invention.

The basis weight of the release base paper was measured in accordance with ISO 536:2012 and a value of 36.0 g/m$^2$ was found. The density of the release base paper was calculated from the basis weight and the thickness, measured in accordance with ISO 534:2011, and determined to be 0.99 g/cm$^3$. The Cobb Unger (120 s) value was determined in accordance with TAPPI T462 cm-16 and a value 0.3 g/m$^2$ was obtained. The transparency of the release base paper was measured in accordance with DIN 53147:1993-01 and a value of 67.0% was obtained.

The air permeance according to the Gurley method was measured as defined in ISO 5636-5:2013 and a value of 100000 s was determined by extrapolation.

Tensile strength, tear strength and other mechanical parameters of the release base paper were also checked and found to be well suited for further processing of the release base paper.

The release base paper was coated with silicone without any problems and it was found that the siliconized release base paper is highly suitable as a carrier material for self-adhesive labels.

Thus, the release base paper according to the invention combines a low basis weight with at least equal, if not superior, properties compared with a conventional release base paper and thus contributes substantially to a reduction in waste caused by the use of such papers.

The release base paper according to the invention was also used to wrap the smokable material of a commercially available heat-not-burn product. After the smoking article had been consumed, there were clearly fewer stains on the release base paper than on a conventional cigarette paper after consumption of a smoking article of the same brand wrapped in this conventional cigarette paper.

The invention claimed is:

1. Smoking article comprising a smokable material, which is capable of generating an aerosol upon combustion or heating, wherein the smokable material is wrapped with a paper serving as a wrapping material, said paper having a basis weight of at least 25 g/m$^2$ and at most 40 g/m$^2$, and a density of at least 0.90 g/cm$^3$ and at most 1.15 g/cm$^3$, wherein the paper comprises at least 50% by weight softwood pulp and is coated on at least one side with at least two coatings, wherein the first coating is located between the paper surface and the second coating, wherein the second coating is the topmost coating and is a water-soluble film-forming polymer, nano-fibrillated cellulose, micro-fibrillated cellulose or nano-crystalline cellulose, and wherein the Cobb Unger (120 s) value for the surface with said first and second coating is at least 0.01 g/m$^2$ and at most 0.90 g/m$^2$.

2. Smoking article according to claim 1, wherein the basis weight of the paper is at least 30 g/m$^2$ and/or at most 38 g/m$^2$.

3. Smoking article according to claim 1, wherein the density of the paper is at least 0.95 g/cm$^3$ and at most 1.10 g/cm$^3$.

4. Smoking article according to claim 1, wherein the paper comprises at least 70% by weight softwood pulp.

5. Smoking article according to claim 1, wherein the air permeance of the paper, measured in accordance with the Gurley method defined in ISO 5636-5:2013, is at least 40000 s.

6. Smoking article according to claim 1, wherein the paper contains at most 40% by weight hardwood pulp.

7. Smoking article according to claim 1, wherein the paper contains at most 15% by weight filler materials.

8. Smoking article according to claim 7, wherein the paper contains less than 2% by weight filler materials.

9. Smoking article according to claim 1, wherein the first and second coatings are different, wherein the coating material of the first coating is selected from the group consisting of starch, starch derivatives, cellulose derivatives, and combinations thereof, and the coating material of the second coating is selected from the group consisting of latex, polyvinyl alcohol, nano-fibrillated cellulose, micro-fibrillated cellulose, nano-crystalline cellulose, polyvinyl alcohol modified with vinyl groups, carboxy methyl cellulose modified with vinyl groups, nano-fibrillated cellulose modified with vinyl groups, micro-fibrillated cellulose modified with vinyl groups, nanoncrystalline cellulose modified with vinyl groups, and combinations thereof.

10. Smoking article according to claim 9, wherein said water-soluble film-forming polymers are formed by starch, starch derivatives, cellulose derivatives or latex.

11. Smoking article according to claim 1, in which the amount of the first coating is at least 0.1 g/m$^2$ and at most 4.0 g/m$^2$.

12. Smoking article according to claim 1, in which the amount of the second coating is at least 0.5 g/m$^2$ and at most 5.0 g/m$^2$.

13. Smoking article according to claim 1, in which the second coating comprises pigment particles, wherein the pigment particle has a flaky shape, and wherein the pigment particle is selected from the group consisting of kaolin, talcum, magnesium silicates, aluminum silicates and mixtures thereof.

14. Smoking article according to claim 1, in which the Cobb Unger (120 s) value for the coated side of the paper is at least 0.01 $g/m^2$ and at most 0.90 $g/m^2$.

15. Smoking article according to claim 1, wherein the paper has a transparency in accordance with DIN 53147: 1993-01 of at least 55% and at most 80%.

16. Smoking article according to claim 1, wherein the smokable material is heated but not burnt during intended use.

17. Smoking article according to claim 1, in which the Cobb Unger (120 s) value for the coated side of the paper is at least 0.1 $g/m^2$ and at most 0.70 $g/m^2$.

18. Process for manufacturing a paper for wrapping the smokable material of a smoking article according to claim 1, with the following steps:

preparing a pulp-containing suspension, which comprises softwood pulp, applying the pulp-containing suspension to a wire of a paper machine in order to form a base paper, calendering the base paper to adjust the density of the base paper, coating the base paper with a first coating, drying the first coating, applying a second coating, which is a topmost coating, either directly or indirectly with one or more further layers in between, to the first coating, wherein the second coating comprises a water-soluble film-forming polymer, nano-fibrillated cellulose, micro-fibrillated cellulose or nano-crystalline cellulose, and drying the second coating, wherein the proportion of softwood pulp in the pulp-containing suspension is selected such that the finished paper comprises at least 50% by weight softwood pulp, the amount of pulp-containing suspension that is applied to the wire of the paper machine is selected such that the finished paper has a basis weight of at least 25 $g/m^2$ and at most 40 $g/m^2$, and the step of calendering is carried out such that the finished paper has a density of at least 0.90 $g/cm^3$ and at most 1.15 $g/cm^3$, and wherein the first and the second coating are selected such that the Cobb Unger (120 s) value for the surface with said first and second coating on the finished paper is at least 0.01 $g/m^2$ and at most 0.90 $g/m^2$.

19. Process according to claim 18, wherein the amount of pulp-containing suspension that is applied to the wire of the paper machine is selected such that the finished paper has a basis weight of at least 30 $g/m^2$ and/or at most 38 $g/m^2$.

20. Process according to claim 18, wherein the step of calendering is carried out such that the density is at least 0.95 $g/cm^3$ and at most 1.10 $g/cm^3$.

21. Process according to claim 18, in which the base paper in the calendering process is compressed between a plurality of pairs of rolls, wherein each pair of rolls forms a nip through which the base paper is guided.

22. Process according to claim 18, wherein the proportion of softwood pulp in the pulp-containing suspension is selected such that the finished paper comprises at least 70% by weight softwood pulp.

23. Process according to claim 18, in which the finished paper has an air permeance, measured in accordance with the method defined ISO 5636-5:2013 according to Gurley, of at least 40000 s.

24. Process according to claim 18, in which the step of manufacturing the pulp-containing suspension contains a step in which the softwood pulp is refined to a degree of refining of at least 50° SR and at most 80° SR.

25. Process according to claim 18, in which the first coating comprises a coating material that is selected from the group consisting of water-soluble film-forming polymers; nano-fibrillated cellulose, micro-fibrillated cellulose; nano-crystalline cellulose and mixtures thereof; and the second coating comprises a water-soluble film-forming polymer, nano-fibrillated cellulose, micro-fibrillated cellulose or nano-crystalline cellulose.

26. Process according to claim 25, in which the first coating is applied by means of a first coating composition which comprises water and said coating material, wherein the amount of the dried first coating composition which remains after drying on the paper is at least 0.1 $g/m^2$ and at most 4.0 $g/m^2$.

27. Process according to claim 18, wherein the second coating comprises a water-soluble, film-forming polymer, nano-fibrillated cellulose, micro-fibrillated cellulose or nano-crystalline cellulose and is applied in form of a second coating composition which comprises water and said film-forming polymer, the nano-fibrillated cellulose, micro-fibrillated cellulose or nano-crystalline cellulose.

28. Process according to claim 18, in which the second coating composition comprises pigment particles, wherein the pigment particles have a flaky shape, and wherein the pigment particles are selected from the group consisting of kaolin, talcum, magnesium silicates, aluminum silicates, calcium carbonate and mixtures thereof, wherein the pigment particles make up at least 1% by weight, and at most 30% by weight with respect to the weight of the second coating composition.

29. Process according to claim 18, in which the film-forming polymer of the second composition is selected from the group consisting of polyvinyl alcohol, carboxy methyl cellulose, hydroxy methyl cellulose, starch, starch derivatives, latex and mixtures thereof.

30. Process according to claim 18, in which the paper machine is a Fourdrinier paper machine and/or in which a calendering device is integrated into the paper machine, so that the calendering can be carried out during production of the base paper and/or in which the first and/or the second coating composition is applied in a size press, in a film press, by blade coating or a curtain coating process.

* * * * *